US006233905B1

(12) United States Patent
Singh

(10) Patent No.: US 6,233,905 B1
(45) Date of Patent: May 22, 2001

(54) FILL AND FORM WITH MULTIPLE FLAT PACKAGES

(75) Inventor: Balbir Singh, Media, PA (US)

(73) Assignee: Ethicon, Inc., Somerville, NJ (US)

( * ) Notice: Subject to any disclaimer, the term of this patent is extended or adjusted under 35 U.S.C. 154(b) by 0 days.

(21) Appl. No.: 09/163,281

(22) Filed: Sep. 29, 1998

Related U.S. Application Data

(60) Provisional application No. 60/060,412, filed on Sep. 30, 1997.

(51) Int. Cl.[7] ..... B65B 43/26

(52) U.S. Cl. ..... 53/381.1; 493/55

(58) Field of Search ..... 53/457, 458, 481, 53/381.1; 493/52, 55, 51; 206/494, 499

(56) References Cited

U.S. PATENT DOCUMENTS

| | | | | |
|---|---|---|---|---|
| 1,816,085 | | 7/1931 | Langhammer . | |
| 2,107,482 | | 2/1938 | Kemp . | |
| 2,153,483 | | 9/1939 | Rose . | |
| 2,620,964 | | 10/1952 | Rose et al . | |
| 2,968,901 | | 1/1961 | Johnson . | |
| 3,114,300 | * | 12/1963 | Bianchi | 493/55 |
| 3,372,526 | | 3/1968 | Anderson . | |
| 3,383,825 | | 5/1968 | Titchenal et al. . | |
| 3,507,088 | | 4/1970 | Mizelle et al. . | |
| 3,763,629 | | 10/1973 | Carlstrom et al. . | |
| 3,779,152 | * | 12/1973 | Smith | 206/494 |
| 3,803,797 | | 4/1974 | Duchinsky et al. . | |
| 3,949,932 | | 4/1976 | Shore . | |
| 3,986,319 | | 10/1976 | Puskarz et al. . | |
| 4,186,544 | | 2/1980 | Johnson . | |
| 4,459,127 | * | 7/1984 | Kunzel | 206/494 |
| 4,577,453 | | 3/1986 | Hofeler . | |
| 4,691,368 | | 9/1987 | Roessiger . | |
| 4,832,198 | | 5/1989 | Alikhan . | |
| 4,934,535 | | 6/1990 | Muckenfuhs et al. . | |
| 4,966,286 | | 10/1990 | Muckefuhs . | |
| 5,022,216 | | 6/1991 | Muckenfuhs et al. . | |
| 5,050,742 | | 9/1991 | Muckenfuhs . | |
| 5,054,619 | | 10/1991 | Muckenfuhs . | |
| 5,065,868 | | 11/1991 | Cornelissen et al. . | |
| 5,165,545 | * | 11/1992 | Focke et al. | 206/494 |
| 5,184,725 | | 2/1993 | Reinheimer et al. . | |
| 5,282,687 | | 2/1994 | Yee . | |
| 5,361,905 | | 11/1994 | McQueeny et al. . | |
| 5,377,837 | * | 1/1995 | Roussel | 206/494 |
| 5,380,094 | | 1/1995 | Schmidt et al. . | |
| 5,427,245 | | 6/1995 | Roussel . | |
| 5,537,806 | | 7/1996 | Grierson et al. . | |
| 5,564,562 | | 10/1996 | Focke et al. . | |
| 5,581,047 | * | 12/1996 | Lazaroff | 206/494 |
| 5,588,281 | | 12/1996 | Boriani et al. . | |
| 5,722,774 | | 3/1998 | Hartz . | |
| 5,924,559 | * | 7/1999 | Carrel et al. | 206/494 |
| 5,967,321 | * | 10/1999 | Sigl | 206/494 |

FOREIGN PATENT DOCUMENTS

| | | |
|---|---|---|
| 424 718 | 6/1990 | (EP) . |
| 798 212 | 3/1996 | (EP) . |
| 417 792 | 10/1934 | (GB) . |

* cited by examiner

*Primary Examiner*—Eugene Kim
(74) *Attorney, Agent, or Firm*—A. C. Farmer; T. J. Shatynski

(57) ABSTRACT

A package for holding and displaying a plurality of separately packaged flat items comprises a paper wrapping folding into a free-standing bag and containing the items in parallel stacked relation. The upper edges of the packages preferably protrude above the top of the bag for easy removal therefrom. Preferably, the bag is formed by folding a blank of paper stock about a stack of the items.

8 Claims, 11 Drawing Sheets

FILL AND FORM WITH MULTIPLE FLAT PACKAGES

PRIOR APPLICATIONS

This application claims priority from U.S. application Ser. No. 60/060,412 filed Sep. 30, 1997.

FIELD OF THE INVENTION

The present invention relates to packages of multiple flat items and to methods of packaging such items.

BACKGROUND OF THE INVENTION

Medical sponges typically comprise a layer of cotton or other absorbent fabric gauze or gauze-like fabric folded over one or more times to make an absorbent pad. Raised foams and the like may also be used. Typically such sponges are sterile, substantially flat, and are packaged in flat bacteria-proof envelopes, such as between a pair of paper sheets adapted to peel apart. Typically, such individually packaged sponges are provided in a cardboard box holding a dozen or more sponges.

Cardboard is expensive, heavy and difficult to work with. Applicant has devised a packaging methodology employing paper rather than cardboard which is cheaper to purchase, manufacture and work with and which provides and environmental benefits by generating less waste.

SUMMARY OF THE INVENTION

A display package of substantially flat items according to the present invention comprises an outer wrap formed of a folded blank of thin, paper or paper-like stock, with a first face and a second face. A first pair of spaced-apart, parallel fold lines define a first left-side panel, a first central panel and a first right side panel, and a second pair of spaced-apart, parallel fold lines, normal to the first pair, define a second left-side panel, a second central panel and a second right side panel. In its folded configuration, the first left-side panel and the first right-side panel are folded inwardly toward the first face and the first central panel. Also, the second left-side panel and the second right-side panel are folded inwardly toward the first face and the second central panel. This folding produces a free-standing enclosure. A plurality of the separately packaged, substantially flat items in parallel stacked relation to each other are disposed within the free-standing enclosure for convenient transport and display the items.

A method of packaging a plurality of flat items according to the present invention comprises the steps of enclosing one or more of the items within a substantially flat inner package and providing a blank of paper or paper-like stock having a first face and a second face; folding the blank into a free-standing enclosure. This is accomplished by folding the blank along a first pair of spaced-apart, parallel fold lines which define a first left-side panel, a first central panel and a first right side panel. The first left-side and right side panels are folded inwardly toward the first face and the first central panel. The blank is folded along a second pair of spaced-apart, parallel fold lines which are normal to the first pair and which define a second left-side panel, a second central panel and a second right side panel. The second left-side and rights side panels are folded inwardly toward the first face and the second central panel. A plurality of the substantially flat inner packages in parallel relation to one another are enclosed within the free-standing enclosure. Preferably, the blank is folded about the stacked packages to form and fill the enclosure simultaneously.

DETAILED DESCRIPTION

Figure 1:
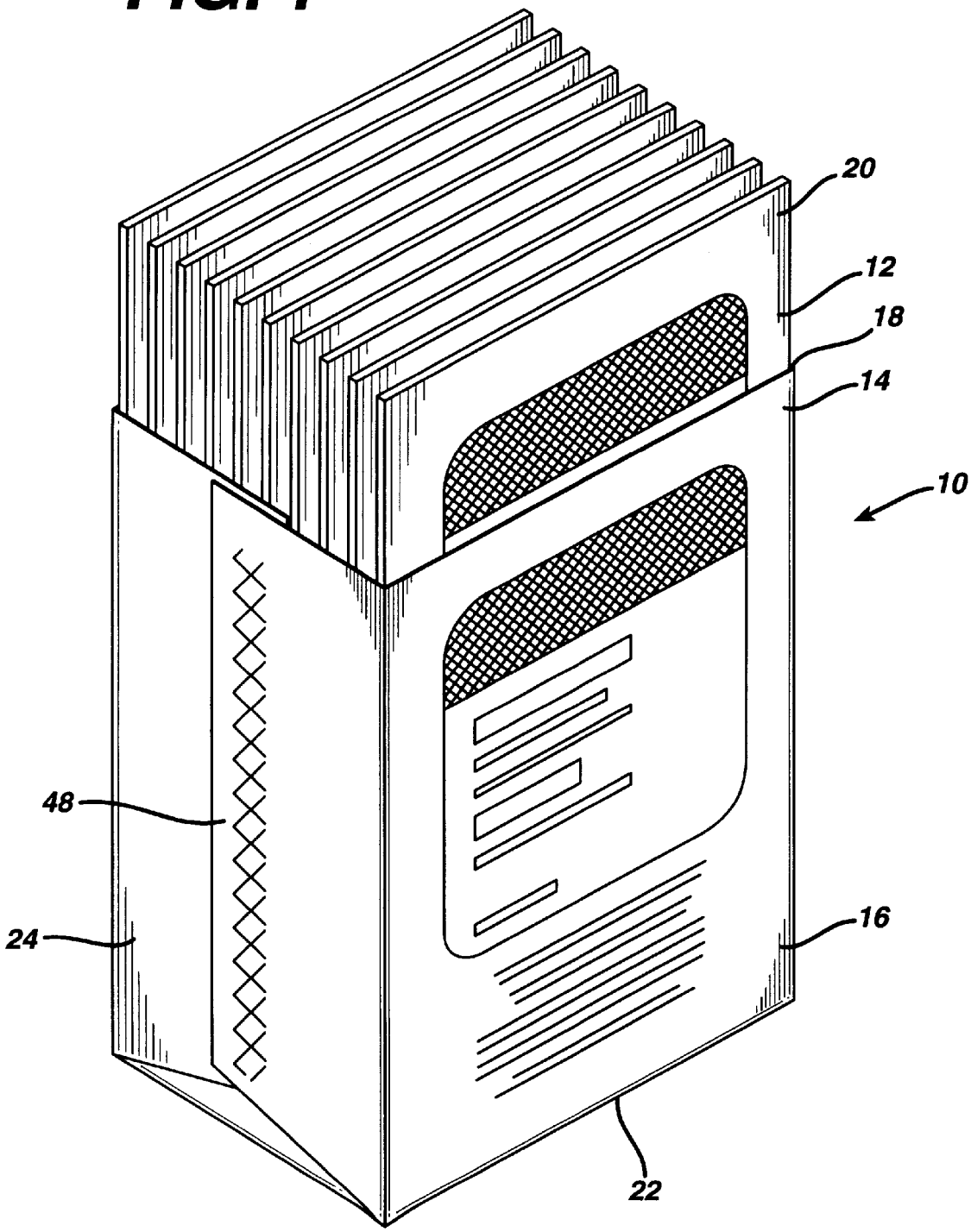
FIG. 1 is a perspective view of a package of individually packaged flat items according to the present invention.

FIG. 1 illustrates a package 10 according to the present invention. It comprises a plurality of separately packaged medical sponges 12 within an outer wrap 14 of a paper or paper-like material folded into a free-standing container 16 configuration. The container 16 has an open upper end 18 above which project upper edges 20 of the sponges 12. The container 16 has a construction similar to the well known paper sack used for carrying groceries or other items home from a market. It has a flat, rectangular bottom 22 and four interconnected sides 24 projecting upwardly therefrom. Although formed of paper, this configuration allows the container 16 to stand upright and maintain its shape, thus allowing for convenient display and dispensing of the sponges 12 therefrom. Preferably the outer wrap 14 is formed of 40 pound machine calendered bleached white Kraft paper. Lighter paper may be used, but the paper should not be so light that with only a few sponges 12 within the package 10 it becomes top heavy and tips over. Heavier papers may also be employed, such as a 55 pound paper, or even heavier, but heavier papers tend to dilute the advantages of the invention due to their increased cost and environmental waste. Thus, the paper should be as light as practicable to avoid tipping of the partially empty package 10. Adjustment of these parameters is well within the abilities of one with ordinary skill in the art and can be achieved without undue experimentation. The paper may be treated to improve its water repellency, but this is not necessary. Other paper like materials may be substituted therefor. For instance, many plastic films offer handling qualities similar to paper, albeit with added expense and with likely greater impact upon the environment.

Figure 2:
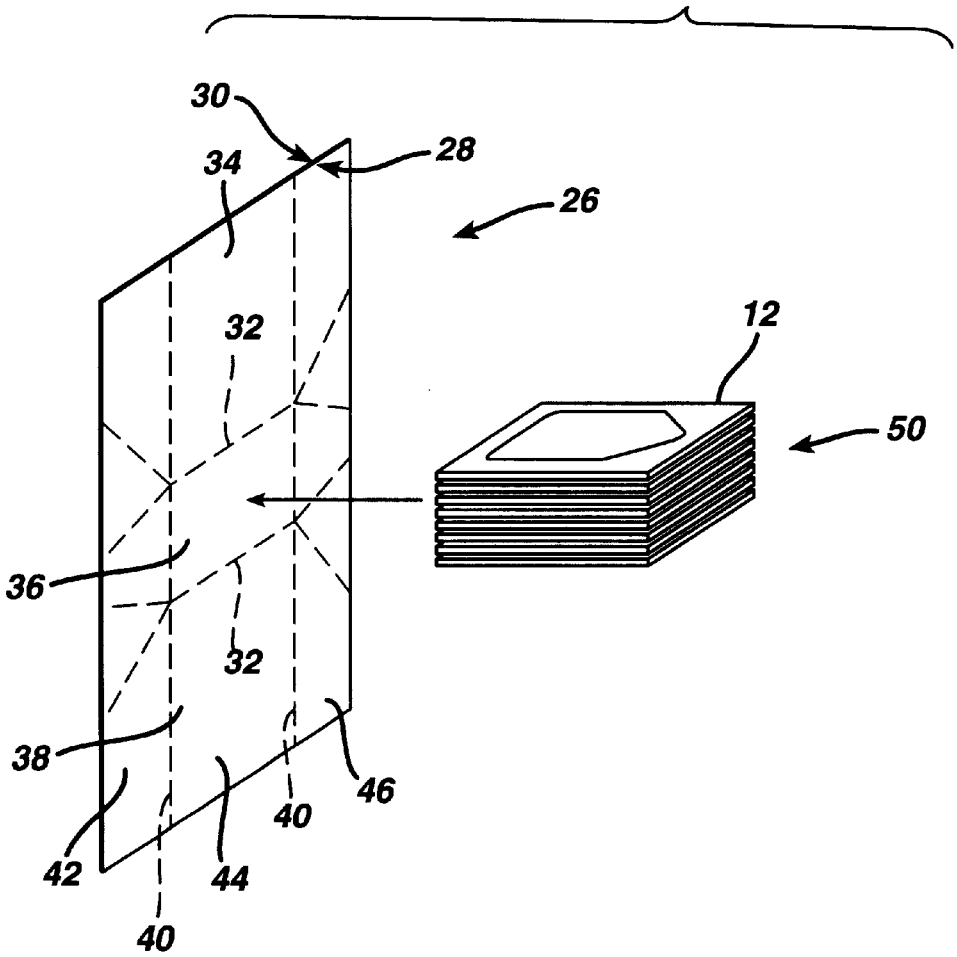
FIG. 2 is a perspective view of a blank of stock that forms the package of FIG. 1.
Figure 3:
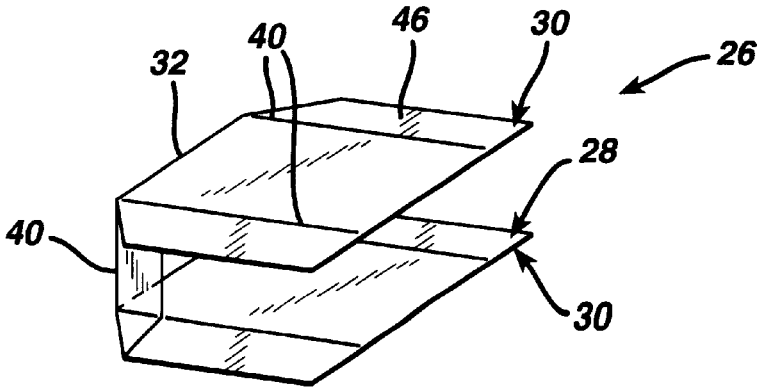
FIG. 3 is a perspective view of a the partially folded blank of FIG. 2.

Turning to FIG. 2, the outer wrap 14 starts as a blank 26 of the paper or paper-like material. The blank 26 has a first face 28 and a second face 30. A first pair of spaced-apart, parallel fold lines 32 define a first left-side panel 34, a first central panel 36 and a first right side panel 38. A second pair of spaced-apart, parallel fold lines 40, normal to the first pair of fold lines 32, defines a second left-side panel 42, a second central panel 44 and a second right side panel 46. Of course, the fold lines are preferably imaginary and only formed during the actual folding process, rather than being pre-marked or formed. Turning to FIG. 3, to prepare the folded configuration 16, the first left-side panel 34 and the first right-side panel 38 are folded inwardly toward the first face 28 and the first central panel 36. Then the second left-side panel 42 and the second right-side panel 46 are folded inwardly toward the first face 28 and the second central panel 44. Overlapping edges 48 of the second right side panel 46 are glued to each other as are the overlapping edges 48 of the second left side panel 42, thus holding the container 16 in the folded configuration.

One particularly adequate adhesive is a water based ethylene vinyl acetate emulsion adhesive, such as CX4131EF01 available from ATO Findley, Inc. In the present process, such adhesive is heated to 420° F. for approximately one second under 100 psi to activate the adhesive. Other suitable adhesive methods include pressure sensitive glues, cold glues and hot melt adhesives.

The process for forming and filling the container 16 is preferably automated. FIGS. 4 to 12 illustrate an automated process for forming the container 16 around a stack 50 of the sponges 2.

Figure 4:
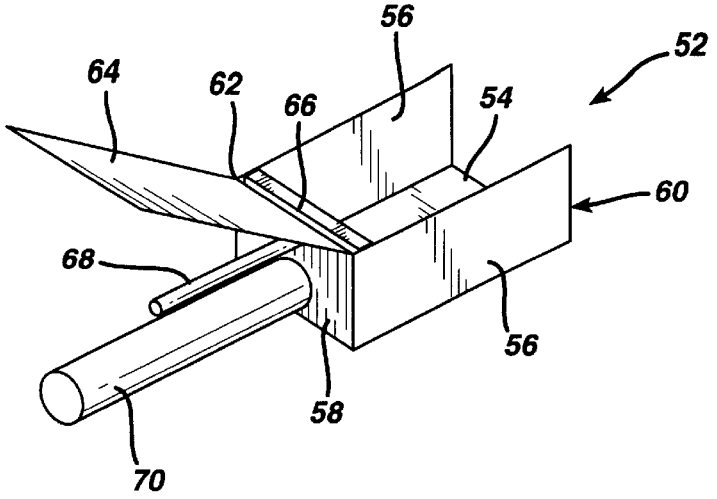
FIG. 4 is a perspective view of a form for holding a stack of individually packaged items and about which a package can be folded according to the present invention.
Figure 5:
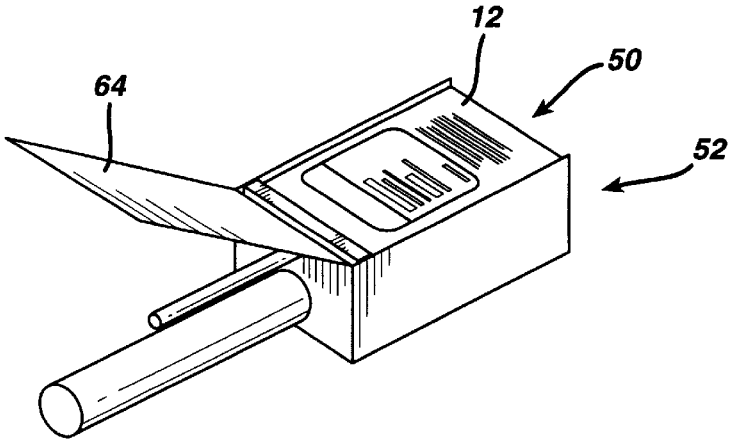
FIG. 5 is a perspective view of the form of FIG. 4 with a stack of individually packaged items therein and a lid which is shown in an open position.
Figure 6:
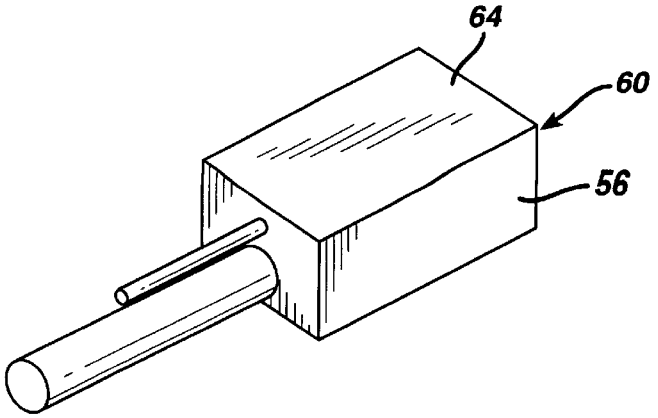
FIG. 6 is a perspective view of the form of FIG. 5 with the lid closed.

FIG. 4 illustrates a mandrel form 52 about which the blank 26 can be folded. The form 52 comprises a rectangular bottom wall 54 of similar size and shape to the sponges 12, a pair of upstanding side walls 56, and a rear wall 58. A forward end 60 of the form 52 is open. A hinge 62 affixes a lid 64 onto the rear wall 58. A stripper plate 66 sits within the form 52 adjacent to the rear wall 58 and a dowel 68 projects rearwardly therefrom through the rear wall 58 to allow fore and aft movement of the stripper plate 66 through the form 52 by manipulation of the dowel 68. A push rod 70 projects rearwardly from the rear wall 58 to allow fore and aft movement of the entire form 52 by manipulation of the push rod 70.

To begin the fill and form process, the lid 64 is opened and the stripper plate 66 is retracted to the rear wall 58. A plurality of sponges 12 are stacked within the form 52 upon the bottom wall 54 and the lid 64 is rotated closed. A blank 26 is placed in front of the form forward end 60. The blank preferably is pre-printed with label indicia, trademarks and instructions as well as with the aforementioned heat activated adhesive, and preferably is fed from a roll of pre-printed stock (not shown) which is indexed and cut in a well known fashion to present a pre-printed, pre-cut blank to the form forward end 60.

The form extends and moves into the blank 26 and then between upper and lower rollers 72 which fold the blank 26 over the lid 64 and bottom wall 54 of the form 52 and thereby create the first fold lines 32. As the form 52 continues forward, a pair of L-shaped pressing members 74 engage the blank and press it against the form side walls 56 to partially form the second fold lines 40.

The second right and left panels 42 and 46 extend laterally of the side walls 56 at the lid 64 and bottom wall 54 and are folded against the side walls 56 by a pair of side folders 76. They comprise vertically oriented plates on either side of the form 52 immediately past the pressing members 74 with triangular folding plows 78 therein which abut the laterally extending panels 42 and 46 and begin the folding in thereof as the form 52 is moved past the side folders 76. A bottom camming surface 80 of each folding plow 78 extends further toward the form 52 and is steeper than its corresponding upper camming surface 82 to fold the bottom portion of the laterally extending panels 42 and 46 first and then fold the top portion thereover. Pressure rollers 84 along the side walls 56 provide 100 psi of pressure at 420° F. for one second to activate and a pre-printed strip of adhesive 86 and thereby seal the overlapping edges 48 of the second right and left panels. Finally, the dowel 68 is extended forwardly, moving the stripper plate 66 forwardly to push the completed package 10 out of the form 52. The formed and filled package 10 is preferably shipped and used as is, or may be overwrapped with a bacteria-proof wrapping such as a plastic shrink-wrap.

Figure 13:
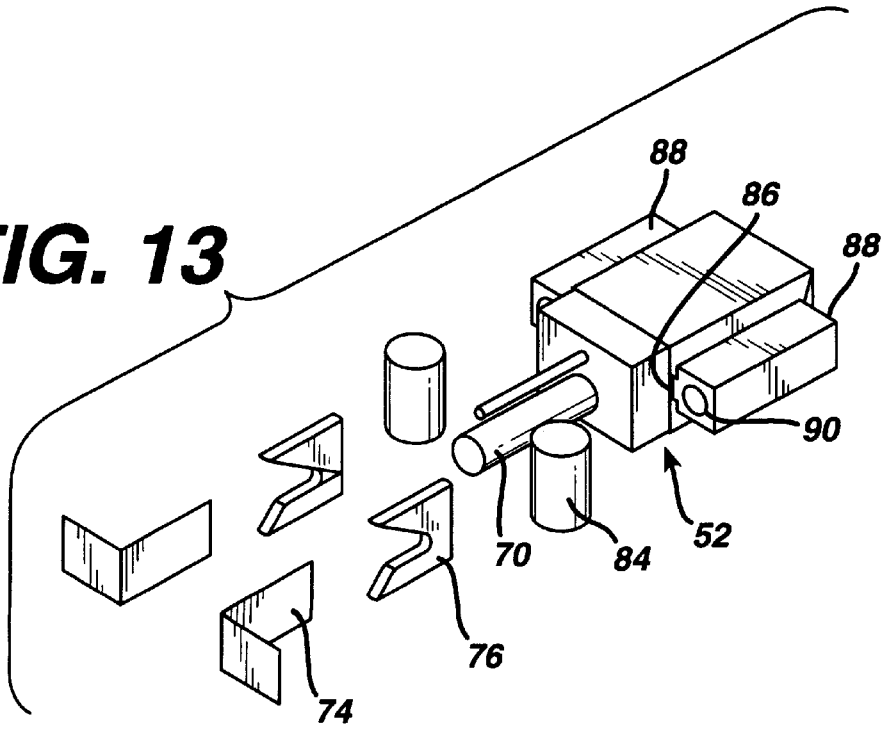
FIG. 13 is an exploded perspective view of a modification to the forming apparatus of FIG. 7, in which heat for activating the adhesive is applied through separate heating sealing bars.

Heat for activating the adhesive need not be applied by the rollers 84, and is preferably applied by separate heating bars 88 downstream of the rollers 84 as is shown in FIG. 13. The heating bars 88 are preferably heated by cartridge heaters 90.

Figure 14:
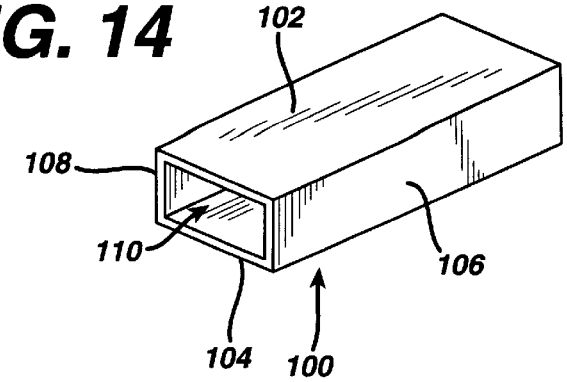
FIGS. 14 to 17 show in perspective view an alternative embodiment of a mandrel/form according to the present invention.
Figure 15:
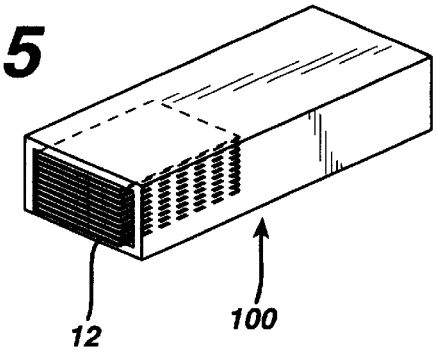
Figure 16:
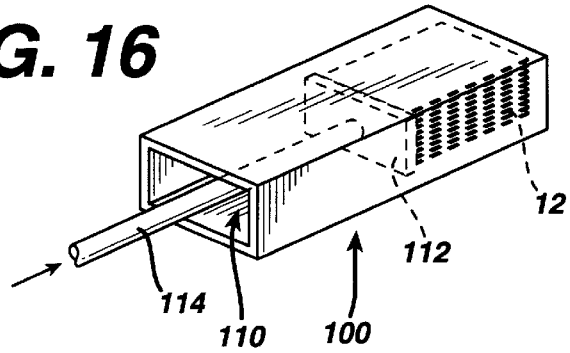
Figure 17:
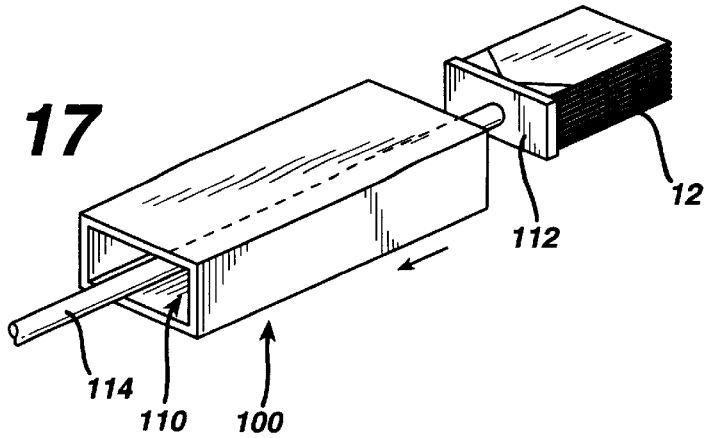

FIGS. 14 to 16 illustrate an alternative embodiment of a mandrel/form 100 in the form of a hollow, rectangular cylinder having a top wall 102, and bottom wall 104 and opposing first and second side walls 106 and 108 respectively to form a cavity 110 to receive a stack of sponges 12. A piston 112 affixed to a pushrod 114 is employed for pushing the stack of sponges 12 through the form 100 and out of the cavity 110 by moving the mandrel/form 100 and piston 112 relative to one another, as best illustrated in FIG. 16. For instance, the piston 112 may first push the sponges 12 out of the cavity 110 and the mandrel/form 100 may then retract away from the sponges 12, see FIG. 17.

Figure 7:
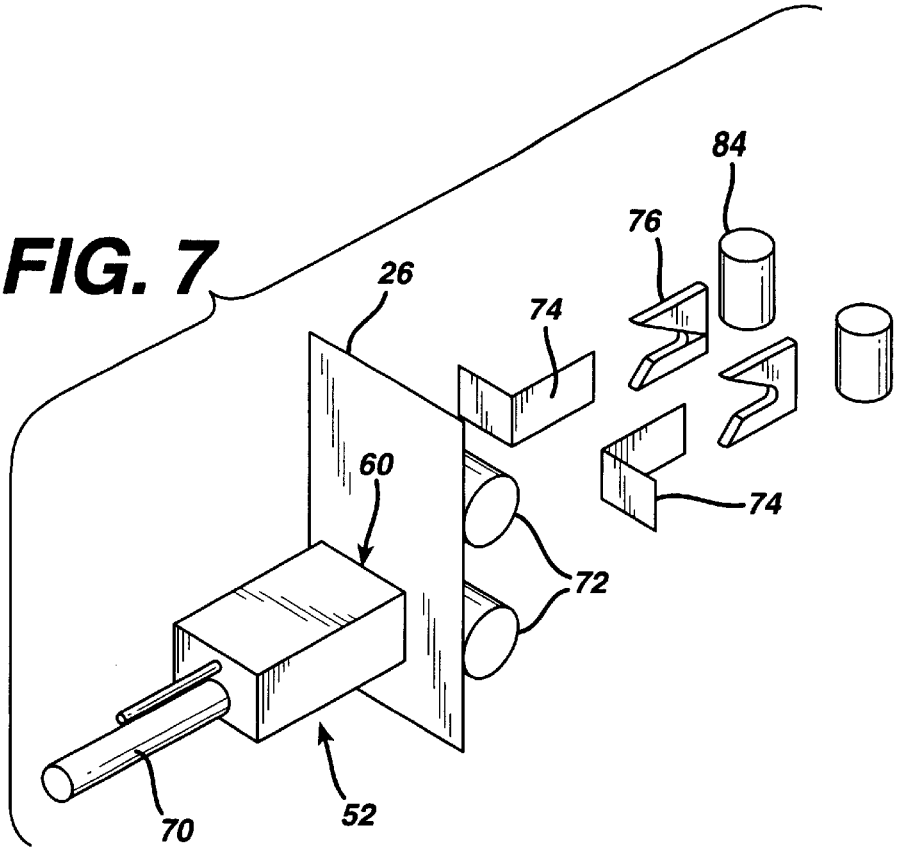
FIG. 7 is an exploded perspective view of the key elements of a forming apparatus for folding the blank about the form of FIG. 5, shown with the unfolded blank in preparation for folding.
Figure 8:
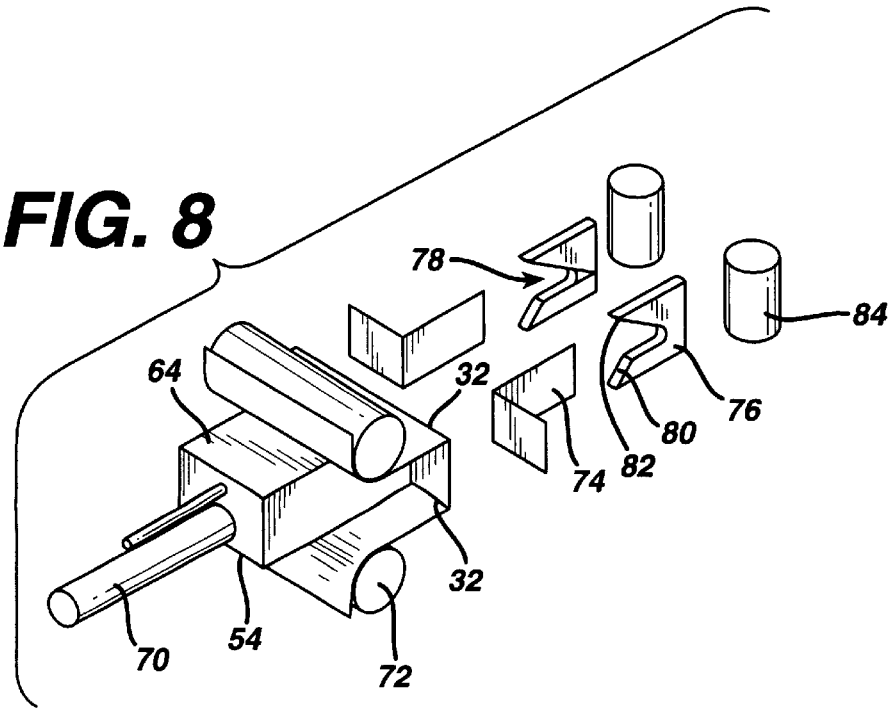
FIG. 8 is an exploded perspective view of the forming apparatus of FIG. 7, shown with the form pressing the blank between upper and lower rollers to fold the form over upper and lower portions of the form.
Figure 18:
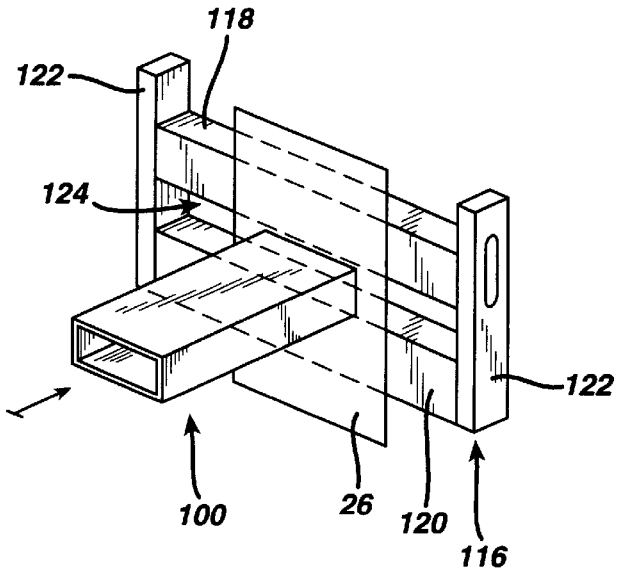
FIGS. 18 and 19 show in perspective view an alternative embodiment of a portion of the forming apparatus in which the blank is folded over the mandrel through an aperture in a frame.
Figure 19:
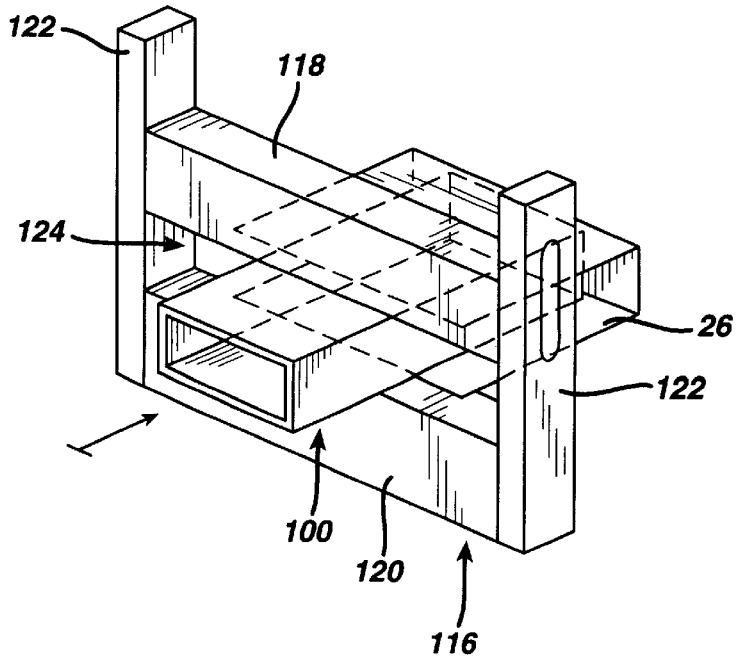

FIGS. 18 and 19 illustrate an alternative to the upper and lower rollers 72 of FIGS. 7 and 8. In this alternative, a frame 116 formed of an upper beam 118, lower beam 120 and opposing side beams 122 form a rectangular aperture 124 through which the mandrel/form 100 pushes the blank 26 to fold the blank over the mandrel/form's 100 top wall 102 and bottom wall 104. The upper beam 118 may be vertically adjustable.

Figure 9:
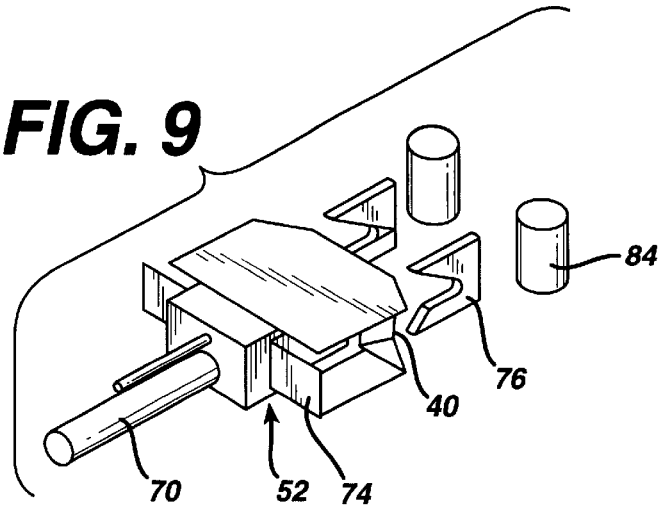
FIG. 9 is an exploded perspective view of the forming apparatus of FIG. 7, shown with a pair of side forming members folding the blank over side portions of the form.
Figure 10:
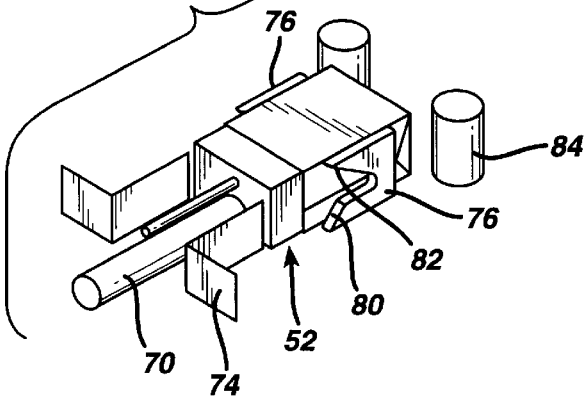
FIG. 10 is an exploded perspective view of the forming apparatus of FIG. 7, shown with side folding members folding upper and lower overhanging portions of the blank over the sides of the form.
Figure 11:
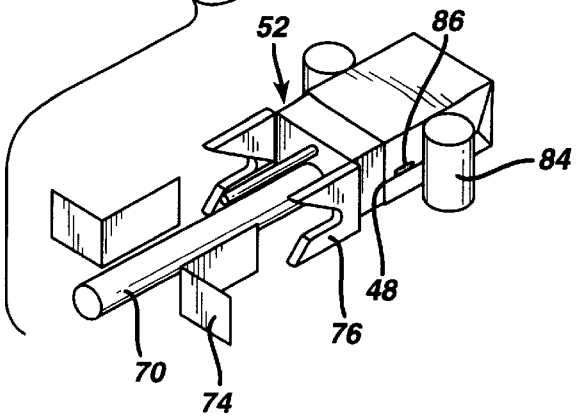
FIG. 11 is an exploded perspective view of the forming apparatus of FIG. 7, shown with side rollers sealing adhesive along overlapping portions of the blank at the form sides.
Figure 12:
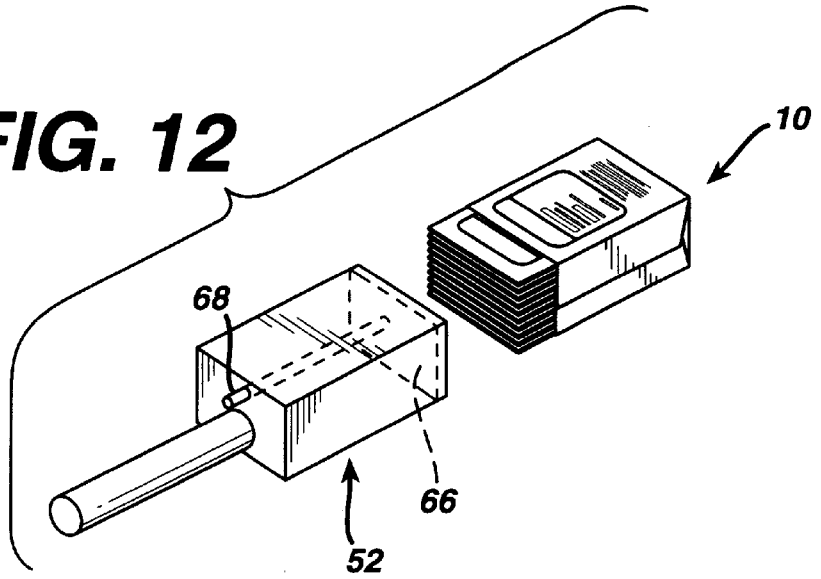
FIG. 12 is an exploded perspective view of the forming apparatus of FIG. 7, shown with a stripper plate extended forwardly in the form to push the filled and formed package out of the form.
Figure 20:
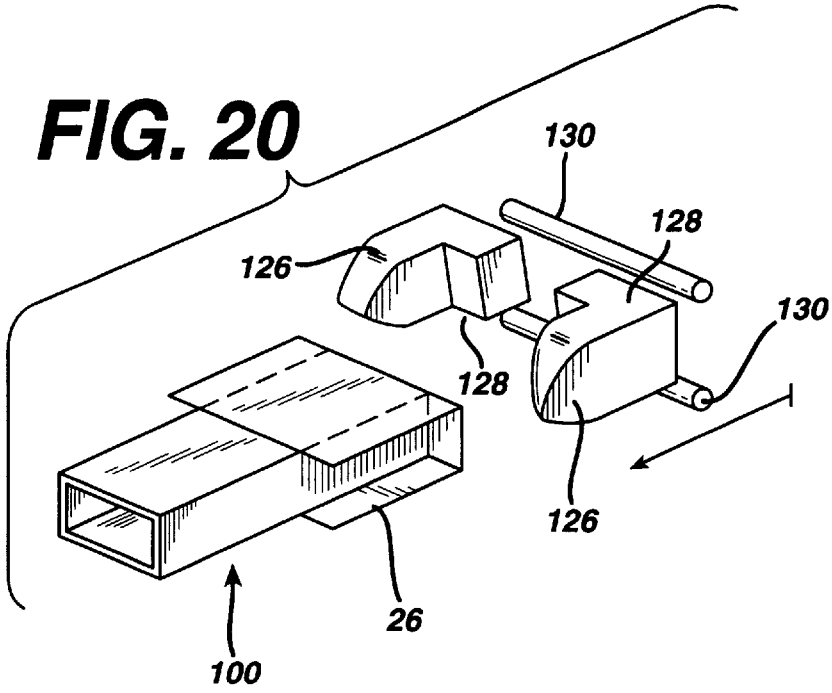
FIGS. 20 and 21 show in perspective view an alternative embodiment of a portion of the forming apparatus for forming creases in the blank.
Figure 21:
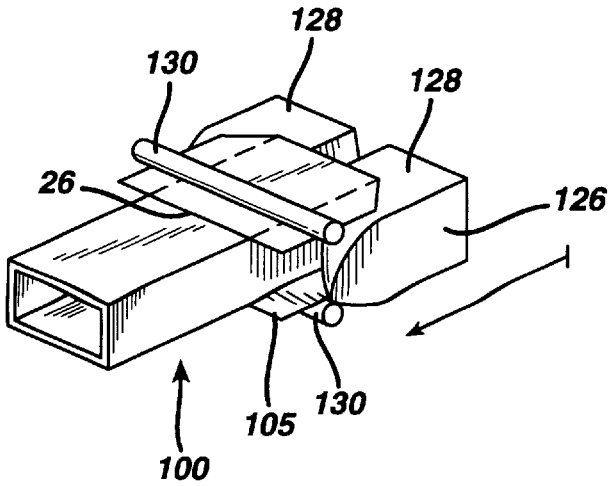

FIGS. 20 and 21 illustrate an alternative method to that shown in FIGS. 9 and 10 for folding the blank 26 and which is particularly well suited for forming 45 degree creases therein. A pair of pressing members 126 operate similarly to the pressing members 74, but each carries a flange 128 which limits its forward movement relative to the mandrel/form 100. A pair of rollers 130 move over the blank 26 along the mandrel/form top wall 102 and bottom wall 104 to crease the blank. The resulting flaps 105 may be folded in using a plow such as the folding plows 78, with members (not shown) that hinge inwardly in similar fashion to the folding of the flaps 105, with vertically moving plows such as the plows 140 and 142 shown in FIG. 26 or other methods as may be known to those of skill in the art.

Figure 22:
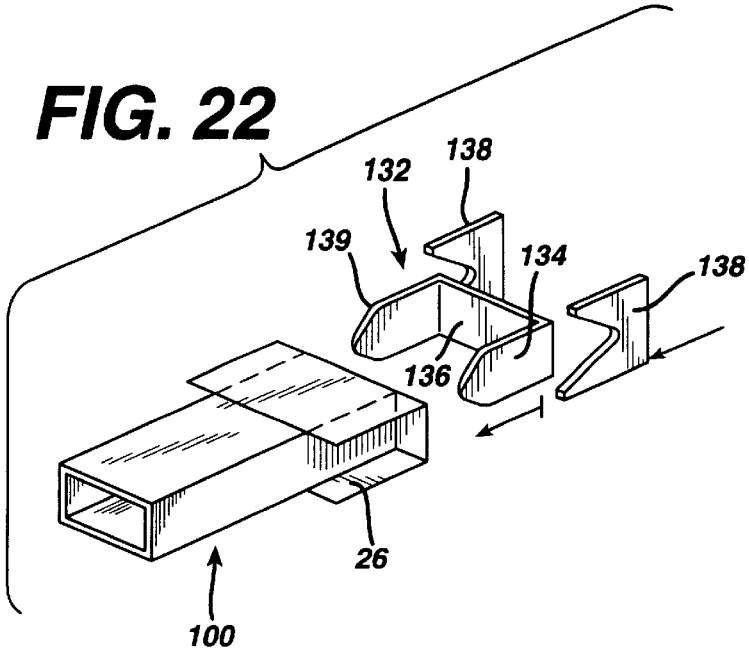
FIGS. 22 to 24 show in perspective view a further alternative embodiment of a portion of the forming apparatus for forming creases in the blank.
Figure 23:
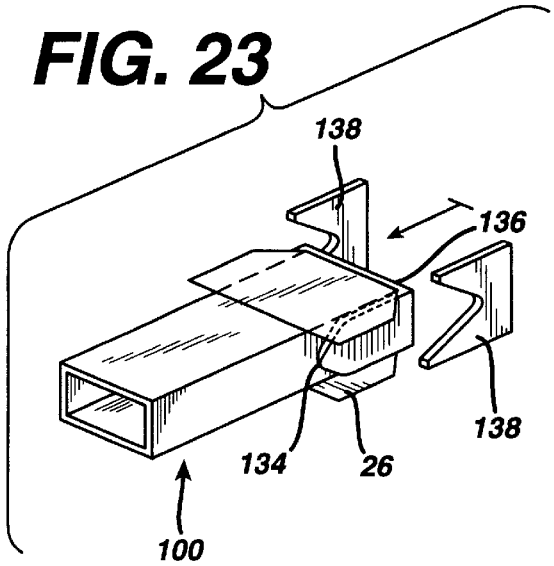
Figure 24:
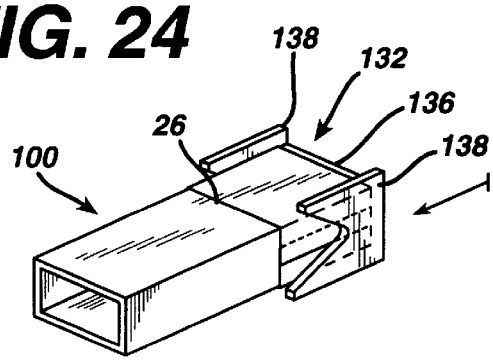

FIGS. 22 to 24 illustrate a further embodiment for creasing the blank wherein a folder 132 comprises a pair of pressing members 134 extending forwardly from a rear panel 136. Similar to the flanges 128 of the previous embodiment, the rear panel 136 limits travel of the folder 132 relative to the mandrel/form 100. A pair of crimpers 138 similar to the side folders 76 complete the folding.

Figure 25:
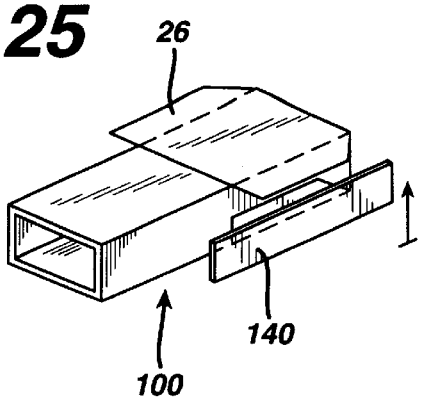
FIGS. 25 to 27 show in perspective view a further embodiment for completing the folding of the blank.
Figure 26:
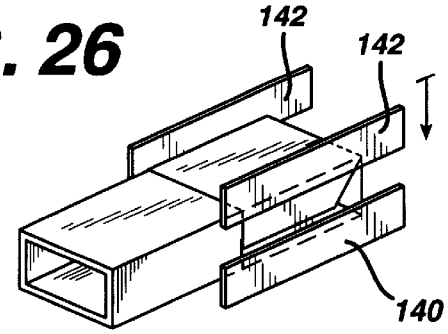
Figure 27:
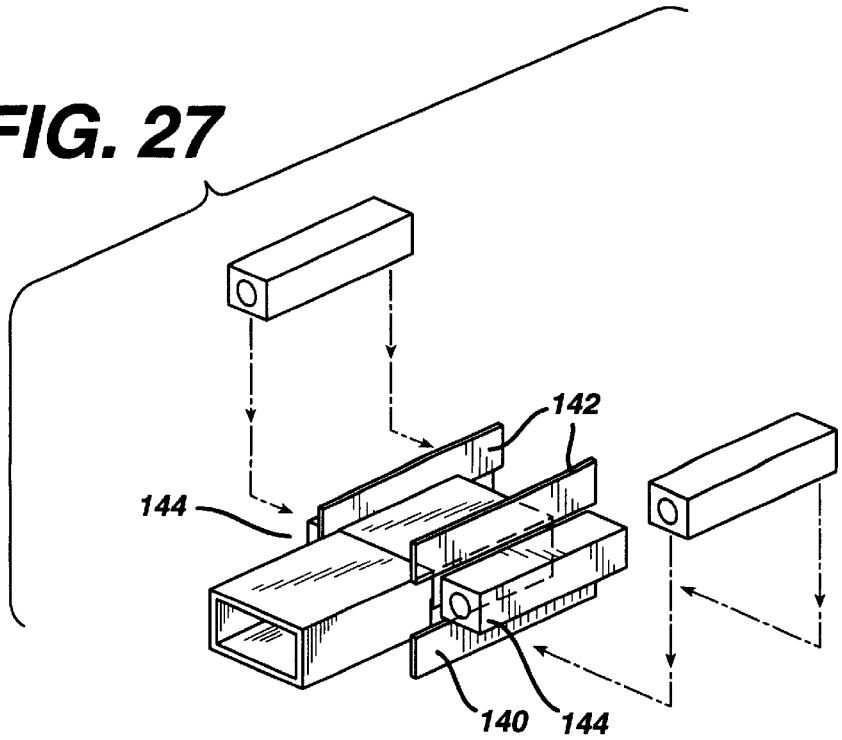

FIGS. 25 to 27 illustrate a further embodiment for completing the folding of the blank 26. At each side 106 and 108 of the mandrel/form 100 a lower plow 140 moves upwardly against the blank 126 and along the sidewall 106 or 108 of the mandrel/form 100, and an upper plow 142 moves downwardly against the blank 126 and along the sidewall 106 or 108 of the mandrel/form 100 to complete folding of the blank 26. A pair of heater platens 144 lower and clamp against the blank 26 between the lower plow 140 and upper plow 142 to heat and seal the blank 26.

Various modifications and alterations of this invention will be apparent to those skilled in the art without departing from the scope and spirit of this invention. It should be understood that the invention is not limited to the embodiments disclosed herein, and that the claims should be interpreted as broadly as the prior art allows.

What is claimed is:

1. A display package of substantially flat items, the package comprising:

an outer wrap formed of a folded blank of paper stock, said blank comprising:

a first face and a second face, a first pair of spaced-apart, parallel fold lines defining a first left-side panel, a first central panel and a first right side panel, and a second pair of spaced-apart, parallel fold lines defining a second left-side panel, a second central panel and a second right side panel, wherein said first and second pairs of spaced-apart parallel fold lines are normal to each other, and wherein said blank has a folded configuration comprising said first left-side panel and said first right-side panel are folded inwardly toward said first face and said first central panel, and said second left-side panel and said second right-side panel are folded inwardly toward said first face and said second central panel, whereby to form a free-standing enclosure having two envelope-type folds; and a plurality of said substantially flat items in parallel stacked relation to each other and disposed within said free-standing enclosure, whereby to display said items.

2. A display package according to claim 1 wherein the paper is cellulose based.

3. A display package according to claim 1 wherein the items are individually packaged in flat packages.

4. A display package according to claim 1 wherein the a portion of said first right-side panel on said second right-side or left-side panel is adhered to a portion of said first right-side panel on the other of said second right-side or left-side panel, and wherein a portion of said first left-side panel on said second right-side or left-side panel is adhered to a portion of said first left-side panel on the other of said second right-side or left-side panel, whereby to maintain said folded configuration.

5. A display package according to claim 1 wherein the items are sterile and packaged in sterile, bacteria-proof packaging.

6. A display package according to claim 5 wherein the items are medical sponges.

7. A display package according to claim 1 wherein the folded configuration comprises said first left-side panel and said first right-side panel being normal to said first central panel and said second left-side panel and said second right side panel being normal to said second central panel.

8. A display package according to claim 1 wherein the free-standing enclosure is open at an upper end thereof, the items are vertically disposed and protrude upwardly above the upper end of the enclosure whereby to allow easy removal therefrom.

* * * * *